US005766505A

United States Patent [19]

Kanamori et al.

[11] Patent Number: 5,766,505

[45] Date of Patent: Jun. 16, 1998

[54] WATER-SOLUBLE QUENCHING MEDIUM

[75] Inventors: Hideo Kanamori, Nagoya; Hitoshi Uchida, Kawasaki; Eiichi Nakamura, Ichihara, all of Japan

[73] Assignee: Idemitsu Kosan Co., Ltd., Tokyo, Japan

[21] Appl. No.: 798,142

[22] Filed: Feb. 12, 1997

[30] Foreign Application Priority Data

Feb. 21, 1996 [JP] Japan ..... 8-033264

[51] Int. Cl.[6] ..... C21D 1/60

[52] U.S. Cl. ..... 252/70; 148/28

[58] Field of Search ..... 252/70; 148/28

[56] References Cited

U.S. PATENT DOCUMENTS

| | | | |
|---|---|---|---|
| 3,802,860 | 4/1974 | Gorman | 65/116 |
| 4,486,246 | 12/1984 | Warchol | 148/18 |
| 4,596,612 | 6/1986 | Fradique | 148/18 |

OTHER PUBLICATIONS

Chemical Abstract No. 96:166693 which is an abstract of Romanian Patent Specification No. 71379 (Jun. 1981).

Chemical Abstract No. 98:183683 which is an abstract of German Patent Specification No. 3,220,931 (Dec. 1982).

Chemical Abstract No. 101:95359 which is an abstract of an article by Koiwai et al entitled "Water-soluble quenching media" (1984).

WPIDS abstract No. 68-86195P which is an abstract of German Patent Specification No. 1,242,660 (Jun. 1968).

WPIDS Abstract No. 75-65751W which is an abstract of German Patent Specification No. 2,411,827 (Sep. 1975).

WPIDS Abstract No. 82-55990E which is an abstract of Japanese Patent Specification No. 57-085923 (May. 1982).

WPIDS Abstract No. 90-321115 which is an abstract of German Patent Specification No. 278912 (May. 1990).

WPIDS Abstract No. 92-013673 which is an abstract of Japanese Patent Specification No. 03-264655 (Nov. 1991).

WPIDS Abstract No. 93-024263 which is an abstract of Japanese Patent Specification No. 04-353441 (Dec. 1992).

*Primary Examiner*—Anthony Green

*Attorney, Agent, or Firm*—Oblon, Spivak, McClelland, Maier & Neustadt, P.C.

[57] ABSTRACT

The invention provides a water-soluble quenching medium suitably usable for quenching of metal, which can prevent quenching cracks and quenching ununiformity while having good hardenability. The medium comprises (A) a polyalkylene glycol having a weight average molecular weight of from 10,000 to 100,000 and/or its derivative, (B) a glycol ether having a weight average molecular weight of 1,000 smaller, and optionally (C) an alkylene glycol having a weight average molecular weight of 1,000 or smaller, (D) an alkali metal carboxylate, and (E) an organic amine compound having a weight average molecular weight of 1,000 or smaller.

21 Claims, No Drawings

WATER-SOLUBLE QUENCHING MEDIUM

FIELD OF THE INVENTION

The present invention relates to a water-soluble quenching medium and, precisely, to a long-life, water-soluble quenching medium which is used for quenching of metal and has good quenching properties of preventing quenching cracks and quenching ununiformity.

BACKGROUND OF THE INVENTION

Quenching media to be used for quenching metal are grouped into aqueous ones (for aqueous quenching solutions), emulsion-type ones and oily ones. Of these, aqueous quenching media are advantageous in that they have a great cooling capacity and that they cause few dangers of environmental pollution and fire, but, on the other hand, are disadvantageous in that they often cause quenching cracks or, that is, the objects quenched therewith are often cracked. This is because, since water has a large heat capacity while having a low viscosity, thereby producing convection currents with ease, the objects as processed with such aqueous quenching media shall lose their heat within an extremely short period of time and are thus cooled rapidly.

In order to solve these problems, for example, it is attempted to add various water-soluble polymers to aqueous quenching media. The addition of water-soluble polymers results in the increase in the viscosity of the resulting aqueous quenching media, thereby preventing convection currents from occurring and preventing the objects quenched from being cracked. The water-soluble polymers employable for this purpose include, for example, polyoxyalkylenes, such as polyethylene glycol, polypropylene glycol and random copolymers of polyethylene glycol and polypropylene glycol in a ratio by weight of 75/25; and salts of copolymers of olefins and maleic anhydride. Also employable are water-soluble copolymers of polyoxyalkylene derivatives and maleic acids such as those disclosed in Japanese Patent Application Laid-Open No. 4-180515.

The conventional quenching media of that type can prevent the objects quenched therewith from being cracked in some degree, but are still defective in that they often cool unevenly the objects being quenched, depending on the surface condition of the objects and on the flow condition of the media used, with the result that the objects quenched therewith through group quenching or those quenched therewith while having scale as formed at random on their surfaces shall have unevenly quenched appearance. In addition, since the conventional quenching media are often decomposed or deteriorated, when kept in contact with very hot objects being quenched therewith, they are still problematic in that they could hardly ensure their effect of preventing quenching cracks for a long period of time.

On the other hand, Japanese Patent Publication No. 57-39294 discloses a means of preventing quenching cracks by the use of aqueous quenching media to which are added lauryl fatty acids. Japanese Patent Application Laid-Open No. 57-85923 discloses a means of improving the clearness of the surfaces of the objects quenched by the use of aqueous quenching media to which are added water-soluble organic acids, water-soluble organic amines and water-soluble polyalkylene glycols. Japanese Patent Publication No. 3-12129 discloses a means of preventing the corrosion of quenching apparatus by the use of aqueous quenching media to which are added water-soluble polyalkylene glycols, carboxylic acids, amines and copper chelating gents.

However, all these known means are not always satisfactory with respect to the ability to prevent quenching cracks, the quenching properties, the ability to prevent quenching ununiformity and the life.

SUMMARY OF THE INVENTION

The present invention is to overcome the drawbacks of the conventional aqueous quenching media, and its object is to provide a water-soluble quenching medium having good ability to prevent quenching cracks, good hardenability and good ability to prevent quenching ununiformity, and even a water-soluble quenching medium having a long life in addition to such good properties.

We, the present inventors have assiduously studied in order to develop an excellent water-soluble quenching medium having the above-mentioned good properties and, as a result, have found that a water-soluble quenching medium comprising a polyalkylene glycol having a particular molecular weight and/or its derivative, and a glycol ether having a particular molecular weight, and optionally containing an alkylene glycol having a particular molecular weight and/or an alkali metal carboxylate has good ability to prevent quenching cracks, good hardenability and good ability to prevent quenching ununiformity, while being hardly deteriorated (or that is, its life is long). On the basis of these findings, we have completed the present invention.

Specifically, the present invention provides;

(1) a water-soluble quenching medium comprising (A) a polyalkylene glycol having a weight average molecular weight of from 10,000 to 100,000 and/or its derivative, and (B) a glycol ether having a weight average molecular weight of 1,000 or lower;

(2) a water-soluble quenching medium comprising said components (A) and (B), and additionally (C) an alkylene glycol having a weight average molecular weight of 1,000 or lower;

(3) a water-soluble quenching medium comprising said components (A) and (B), and additionally (D) an alkali metal carboxylate; and (4) a water-soluble quenching medium comprising said components (A), (B), (C) and (D).

DETAILED DESCRIPTION OF THE INVENTION

The water-soluble quenching medium of the present invention comprises, as the essential components, (A) a polyalkylene glycol having a weight average molecular weight of from 10,000 to 100,000 and/or its derivative, and (B) a glycol ether having a weight average molecular weight of 1,000 or lower, while optionally containing (C) an alkylene glycol having a weight average molecular weight of 1,000 or lower and/or (D) an alkali metal carboxylate, and still optionally (E) an organic amine compound having a weight average molecular weight of 1,000 or lower.

One essential component (A), polyalkylene glycol and/or its derivative, to be in the water-soluble quenching medium of the present invention shall have a weight average molecular weight of from 10,000 to 100,000. If those having a weight average molecular weight that oversteps the defined rage are used, water-soluble quenching media with good quenching crack preventing ability are difficult to obtain. In view of their quenching crack preventing ability, the polyalkylene glycol and its derivative are desired to have a weight average molecular weight of from 20,000 to 100,000. The weight average molecular weight as referred to herein is one as measured through gel permeation chromatography (GPC) in terms of polystyrene.

The polyalkylene glycol and its derivative have repeating oxyalkylene units, of which the both ends are terminated by a hydroxyl group and/or a substituted hydroxyl group to be formed by substituting the hydrogen atom of a hydroxyl group with a suitable substituent such as a hydrocarbon group; and these are not specifically defined provided that they have a weight average molecular weight of from 10,000 to 100,000 and are soluble in water. Preferred examples of these are compounds of a general formula (I):

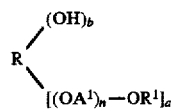

(I)

wherein R represents a hydrogen atom, or a residue to be derived from an aliphatic or aromatic hydroxyl compound by removing its hydroxyl group therefrom; $R^1$ represents a hydrogen atom, or an alkyl or acyl group having from 1 to 10 carbon atoms; a represents an integer of from 1 to 6; b represents an integer of from 0 to 5, while the sum of a and b is an integer of from 1 to 6; provided that, when R is a hydrogen atom, then a is 1 and b is 0; $A^1$ represents an alkylene group having from 2 to 4 carbon atoms, which may be either linear or branched; n is a number that controls the average molecular weight of the compound to fall between 10,000 and 100,000. Where the compound of the formula has two or more —[$(OA^1)$n—$OR^1$] groups, these —[$(OA^1)$n—$OR^1$] groups may be the same or different. In the formula, the oxyalkylene units —$(OA^1)$— may be the same or different. Where the compound of the formula have different oxyalkylene units —$(OA^1)$—, it is a copolymer, which may be either a random copolymer or a block copolymer. Where b is from 1 to 5, the compound of the formula has free hydroxyl group(s). In this case, the hydrogen atom(s) of the hydroxyl group(s) may be partly or wholly substituted with, for example, any of alkyl or acyl groups having from 1 to 10 carbon atoms.

Preferred examples of the polyalkylene glycols and their derivatives of that type include ethylene oxide polymers; propylene oxide polymers; propylene oxide polymers; butylene oxide polymers; copolymers of two or more alkylene oxides selected from ethylene oxide, propylene oxide and butylene oxide; adducts as prepared by adding one or more alkylene oxides selected from ethylene oxide, propylene oxide and butylene oxide to at least one hydroxyl group of aliphatic or aromatic hydroxy compounds having from 1 to 6 hydroxyl groups; and derivatives of such adducts as prepared by substituting the hydrogen atom of the terminal hydroxyl group of said adducts with a suitable substituent such as an alkyl or acyl group having from 1 to 10 carbon atoms.

The aliphatic hydroxy compounds include, for example, monoalcohols such as methyl alcohol, ethyl alcohol, n-propyl alcohol, isopropyl alcohol, n-butyl alcohol, isobutyl alcohol, sec-butyl alcohol, tert-butyl alcohol, hexyl alcohol, cyclohexyl alcohol, 2-ethylhexanol; and polyalcohols such as ethylene glycol, propylene glycol, trimethylene glycol, butane-diol, neopentyl glycol, hexane-diol, octane-diol, cyclohexane-diol, cyclohexane-dimethanol, glycerol, trimethylolethane, trimethylolpropane, pentaerythritol, sorbitol, mannitol, dipentaerythritol.

The aromatic hydroxy compounds include, for example, monophenols such as phenol, cresol, xylenol, ethylphenol; polyphenols such as pyrocatechol, resorcinol, hydroquinone, dihydroxytoluene, phloroglucinol; and arylalkanols such as benzyl alcohol, phenethyl alcohol.

Where alkylene oxide(s) is/are added to such an aliphatic or aromatic polyhydroxy compound, the former may be added to all hydroxyl groups existing in the latter or to a part of them. Where the former is/are added to a part of the hydroxyl groups existing in the latter, all or a part of the hydrogen atoms of the remaining hydroxyl groups may optionally be substituted with a suitable substituent such as an alkyl or acyl group having from 1 to 10 carbon atoms.

The water-soluble quenching medium of the present invention may comprise, as the component (A), one or more of such polyalkylene glycols and/or their derivatives.

The other essential component (B) that constitutes the water-soluble quenching medium of the present invention is a glycol ether having a weight average molecular weight of 1,000 or smaller, preferably 500 or smaller. The glycol ether of this component is essentially to improve the hardenability of the medium, while reducing the cooling ununiformity of the objects being quenched with the medium and thereby preventing the quenching ununiformity of these. If any glycol ether having a weight average molecular weight of larger than 1,000 is used, the quenching medium comprising it could not display satisfactorily the above-mentioned effects. Preferred examples of the glycol ether of that type are compounds having a weight average molecular weight of 1,000 or smaller of a general formula (II):

$$R^2—(OA^2)m—OR^3 \quad (II)$$

wherein $R^2$ and $R^3$ each represent a hydrogen atom (provided that both $R^2$ and $R^3$ must not be hydrogen atoms at the same time), or a hydrocarbon group having from 1 to 15 carbon atoms, and these may the same or different; $A^2$ represents an alkylene group having from 2 to 6 carbon atoms, which may be either linear or branched; and m is a number of 1 or more which controls the weight average molecular weight of the compound to be not larger than 1,000. If the formula has a plurality of oxyalkylene units $(OA^2)$, the individual oxyalkylene units may be the same or different.

The hydrocarbon group having from 1 to 15 carbon atoms to be represented by any of $R^2$ and $R^3$ may be linear, branched or cyclic. Examples of the group include a methyl group, an ethyl group, an n-propyl group, an isopropyl group, an n-butyl group, an isobutyl group, a sec-butyl group, a tert-butyl group, pentyl groups of all types, hexyl groups of all types, a cyclohexyl group, octyl groups of all types, decyl groups of all types, dodecyl groups of all types, cycloalkyl groups of all types, alkenyl groups of all types, aryl groups of all types, and aralkyl groups of all types.

The glycol ethers of that type can be prepared, for example, by homopolymerizing ethylene oxide, propylene oxide or butylene oxide, or by copolymerizing two or more of these. In addition, they can also be prepared by adding at least one of ethylene oxide, propylene oxide and butylene oxide to a monoalcohol having from 1 to 15 carbon atoms optionally followed by substituting the hydrogen atom of the terminal hydroxyl group of the resulting adduct with a hydrocarbon group having from 1 to 15 carbon atoms.

Preferred examples of the glycol ethers are ethylene glycol monobutyl ether, diethylene glycol monobutyl ether, triethylene glycol mono-2-ethylhexyl ether, propylene glycol monobutyl ether, ethylene glycol monophenyl ether, propylene glycol monophenyl ether, ethylene glycol monoallyl ethers, and diethylene glycol diethyl ether.

The water-soluble quenching medium of the present invention may comprise, as the component (B), one or more of such glycol ethers. In the quenching medium of the invention, the ratio of the component (A) to the component (B) may be generally from 2/1 to 200/1 by weight. If the ratio oversteps the defined range, the quenching medium could not display its effects of preventing quenching cracks and preventing cooling ununiformity (quenching ununiformity) and its hardenability is poor. In order to make the quenching medium display its effects advantageously, the ratio of the component (A) to the component (B) in question is preferably from 3/1 to 100/1 by weight, more preferably from 4/1 to 20/1 by weight.

In order to further improve the hardenability of the water-soluble quenching medium of the invention as well as its effect of preventing cooling ununiformity (quenching ununiformity), a component (C), alkylene glycol may optionally be added to the quenching medium.

The component (C), alkylene glycol is one having a weight average molecular weight of 1,000 or smaller, preferably 500 or smaller. If any alkylene glycol having a weight average molecular weight of larger than 1,000 is used, the quenching medium comprising it could not have improved hardenability and its effect of preventing cooling ununiformity is poor.

The alkylene glycol may include compounds of a general formula (III):

$$H-(OA^3)k-OH \quad (III)$$

wherein $A^3$ represents an alkylene group having from 2 to 6 carbon atoms, which may be linear, branched or cyclic; and k is a number of 1 or more which controls the weight average molecular weight of the compound to be not larger than 1,000. In this, the positions of the two hydroxyl groups are not specifically defined.

Examples of alkylene glycols of that type are ethylene glycol; diethylene glycol; triethylene glycol; polyethylene glycols (having a weight average molecular weight of 1,000 or smaller); propylene glycol; dipropylene glycol; tripropylene glycol; polypropylene glycols (having a weight average molecular weight of 1,000 or smaller);trimethylene glycol; 1,2-butane-diol; 1,3-butane-diol; 1,4-butane-diol; 1,5-pentane-diol; neopentyl glycol; 1,6-hexane-diol; and 1,4-cyclohexane-diol. These alkylene glycols can be used either singly or as combined.

The content of the component (C) in the quenching medium of the invention may be generally from 0.5 to 50 parts by weight relative to 100 parts by weight of the sum of the components (A) and (B). If it oversteps the defined range, the quenching medium could not display its effect of preventing cooling ununiformity and its hardenability is poor. In view of the effects of the quenching medium, the content of the component (C) therein is preferably from 2 to 35 parts by weight, more preferably from 3 to 25 parts by weight, relative to 100 parts by weight of the sum of the components (A) and (B).

The water-soluble quenching medium of the present invention may further contain a component (D), alkali metal carboxylate, to thereby prolong its good hardenability and its good effects of preventing quenching cracks and preventing cooling ununiformity (quenching ununiformity) for a longer period of time.

The type of the alkali metal carboxylate to be used for that purpose is not specifically defined, and any alkali metal salts of various aliphatic carboxylic acids and aromatic carboxylic acids can be used herein.

The aliphatic carboxylic acids may be generally aliphatic dicarboxylic acids having from 3 to 36 carbon atoms, preferably from 6 to 20 carbon atoms. Specific examples of such aliphatic dicarboxylic acids include malonic acid; adipic acid; sebacic acid; azelaic acid; eicosanoic diacid; 4-methyl-nonane-1,9-dicarboxylic acid; dimer acids; 1,2-hexane-dicarboxylic acid; 1,3-octanedicarboxylic acid; and 4,5-decane-dicarboxylic acid. Of these, preferred are aliphatic dicarboxylic acids having carboxyl groups at the both ends of the hydrocarbon chain.

The aromatic carboxylic acids may be generally ones having from 7 to 36 carbon atoms, preferably from 7 to 20 carbon atoms. Specific examples of such aromatic carboxylic acids include benzoic acid; 4-ethylbenzoic acid; phthalic acid; isophthalic acid; and salicylic acid. The aromatic carboxylic acid for use in the invention may include compounds having carboxyl group(s) as bonded to only the side chain(s) of the aromatic ring. Specific examples of the compounds of that type are phenoxyacetic acid; and nonylphenoxyacetic acid. Of the aromatic carboxylic acids, preferred are compounds having carboxyl group(s) as bonded to only the side chain(s) of the aromatic ring.

On the other hand, the alkali metals for the alkali metal carboxylates include, for example, lithium, sodium, potassium and cesium. Of these, especially preferred are sodium and potassium in view of the economic aspect thereof.

The water-soluble quenching medium of the present invention may comprise, as the component (D), one or more of such alkali metal carboxylates. The content of the component (D) in the quenching medium may be generally from 0.5 to 25 parts by weight relative to 100 parts by weight of the sum of the components (A) and (B). If it is smaller than 0.5 parts by weight, the component (D) could not satisfactorily display its effect of preventing the deterioration of the quenching medium; but if it is larger than 25 parts by weight, the effect of the component (D) could not be enhanced so much relative to such a large amount thereof added, but such a large amount of the compound (D) added would rather worsen the properties of the quenching medium. In view of the effect of the component (D) of preventing the deterioration of the quenching medium and of the properties of the quenching medium, the preferred content of the component (D) may be from 0.5 to 15 parts by weight, especially preferably from 1 to 9 parts by weight, relative to 100 parts by weight of the sum of the components (A) and (B).

The water-soluble quenching medium of the present invention may still further contain a component (E), organic amine compound.

The organic amine compound for the component (E) is preferably one having a weight average molecular weight of 1,000 or smaller, preferably 500 or smaller. If any organic amine compound having a weight average molecular weight of larger than 1,000 is used, it could not sufficiently display its effects of improving the hardenability of the quenching medium and improving the property of the quenching medium of preventing quenching ununiformity.

The organic amine compound may include, for example, cycloalkylamines having from 4 to 14 carbon atoms, preferably from 6 to 12 carbon atoms; alkanolamines having from 1 to 12 carbon atoms, preferably from 2 to 9 carbon atoms; piperazine derivatives having from 4 to 24 carbon atoms, preferably from 4 to 8 carbon atoms; and morpholine derivatives having from 4 to 34 carbon atoms, preferably from 4 to 16 carbon atoms.

Specific examples of the cycloalkylamines having from 4 to 14 carbon atoms are monocyclohexylamine, dicyclohexylamine, and mono(2-methylcyclopentyl)amine. Specific examples of the alkanolamines having from 1 to 12 carbon atoms are monoethanolamine, diethanolamine, triethanolamine, monomethanol-diethanolamine, and triisopropanolamine. Specific examples of the piperazine derivatives having from 4 to 24 carbon atoms are piperazine, methylpiperazine, tert-butylpiperazine, and N-methylpiperazine. The piperazine derivatives may include those having hydroxyl group(s). Specific examples of the piperazine derivatives of that type are hydroxypiperazine, N-hydroxypiperazine, monohydroxy-monoethylpiperazine, monohydroxy-diethylpiperazine, dihydroxy-monoethylpiperazine, hydroxy-N-methylpiperazine, and N-hydroxy-propylpiperazine. Specific examples of the morpholine derivatives having from 4 to 34 carbon atoms are morpholine, ethylmorpholine, tert-butylmorpholine, dimethylmorpholine, and N-methylmorpholine. Of these, preferred are alkanolamines having from 2 to 9 carbon atoms and piperazine derivatives having from 4 to 8 carbon atoms and having hydroxyl group(s). Especially preferred are diethanolamine and monohydroxy-monoethylpiperazine.

These organic amine compounds can be used singly or as combined.

The content of the component (E) in the quenching medium of the invention may be generally from 0.5 to 50 parts by weight relative to 100 parts by weight of the sum of the components (A) and (B). If it oversteps the defined range, the component (E) could not satisfactorily display its effects of improving the hardenability of the quenching medium and preventing the cooling ununiformity with the medium. In view of its effects, the content of the component (E) is preferably from 0.5 to 15 parts by weight relative to 100 parts by weight of the sum of the components (A) and (B).

The water-soluble quenching medium of the present invention shall comprise at least the component (A) and the component (B) to effectively display its effects. Preferably, however, it additionally contains the component (C) and the component (E) to display its effects more advantageously.

The water content of the water-soluble quenching medium of the invention is not specifically defined and can vary in a broad range. The water-soluble quenching medium of the invention may be either in the form of a stock liquid as prepared for convenience of storage and transportation or in the form of an aqueous solution that may be directly used for quenching of metal. Therefore, the water content of the medium may be generally selected within a range between 10% by weight and 98% by weight. For the form of a stock liquid, the medium may have a water content of generally from 10 to 60% by weight; and for the form of an aqueous solution for direct use in quenching, it may have a water content of generally from 30 to 98% by weight.

The water-soluble quenching medium of the present invention may optionally contain any additives that are generally in conventional quenching media, within the range that does not detract from the objects of the invention. Such additives may include, for example, corrosion inhibitors such as benzotriazole, tolyltriazole; rust inhibitors; copper deactivators; antioxidants; silicone defoaming agents; and colorants.

The water-soluble quenching medium of the present invention can be produced by homogeneously mixing the essential components (A) and (B) with a predetermined amount of water, optionally along with the optional components (C), (D) and (E) and further optionally along with various additives. The order of mixing these components is not specifically defined.

Now, the present invention is described in more detail with reference to the following examples, which, however, are not intended to restrict the scope of the invention. Examples 1 to 3, and Comparative Examples 1 and 2:

As in Table 1 below, the constitutive components were mixed in the indicated ratio (% by weight) to prepare stock liquids of quenching media. Each sample thus prepared herein was diluted into a 20% dilution, which was tested for its effect of preventing quenching ununiformity and for its cooling capacity. The data obtained are shown in Table 1 below.

Test Method

Each sample was tested for its cooling capacity in accordance with JIS-K-2242.

Precisely, each sample was tested for quenching a metal from 800° C. to 150° C. at a bath temperature of 40° C., with no stirring, whereupon the cooling time was measured to be a standard. On the other hand, the same sample was quenched for the same metal under the same condition but stirring at a stirring flow rate of 10 cm/sec, whereupon the cooling time was measured. The difference (as seconds) between the two was obtained, from which the characteristic of the sample of preventing cooling ununiformity was determined. The smaller the absolute value, the smaller the variation in the cooling capacity of the sample. In other words, the smaller absolute value indicates that the object was more uniformly quenched with the sample, or that is, cooling ununiformity hardly occurred in different parts of the object.

TABLE 1

| Amounts of Components | | Examples | | | Comparative Examples | |
|---|---|---|---|---|---|---|
| (% by weight) | | 1 | 2 | 3 | 1 | 2 |
| A | Polyoxyethylene Oxypropylene Glycol (MW = 40,000) | 40 | 40 | 40 | 40 | 40 |
| B | Ethylene Glycol Monobutyl Ether | 5 | — | 3 | — | — |
| | Propylene Glycol Monobutyl Ether | — | 5 | 1 | — | — |
| C | Ethylene Glycol | 5 | 5 | — | — | — |
| | Propylene Glycol | — | 5 | 5 | — | 5 |
| D | Potassium Sebacate | 3 | 3 | 3 | 3 | 3 |
| E | Monohydroxy-monoethylpiperazine | 2 | 2 | 2 | 2 | 2 |
| Water | | 45 | 40 | 46 | 55 | 50 |
| Prevention of Cooling Ununiformity (seconds) | | −0.7 | −0.7 | −0.5 | −2.6 | −3.0 |

As has been described hereinabove, the water-soluble quenching medium of the present invention can prevent quenching cracks and quenching ununiformity while having good hardenability, and in addition, it is hardly deteriorated and has a long life, and further, it involves few dangers of environmental pollution and fire. Thus, the water-soluble quenching medium of the present invention has various excellent characteristics and its industrial value is high.

While the invention has been described in detail and with reference to specific embodiments thereof, it will be apparent to one skilled in the art that various changes and modifications can be made therein without departing from the spirit and scope thereof.

What is claimed is:

1. A water-soluble quenching composition, comprising:

(A) a polyalkylene glycol or a derivative thereof having a weight average molecular weight of from 10,000 to 100,000 and represented by formula (I):

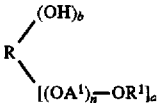

(I)

wherein

R is a hydrogen atom, or a residue derived from an aliphatic or aromatic hydroxyl compound by removing a hydroxyl group therefrom.

$R^1$ is a hydrogen atom, or an alkyl or acyl group having 1 to 10 carbon atoms, a is an integer from 1 to 6, b is an integer from 0 to 5, the sum of a and b is an integer from 1 to 6, provided that, when R is a hydrogen atom, then a is 1 and b is 0, each $A^1$ represents, independently, an alkylene group having 2 to 4 carbon atoms, and n is positive integer greater than or equal to 1; and (B) a glycol ether having a weight average molecular weight of at most 1,000, wherein the weight ratio of (A) to (B) is 2/1 to 200/1.

2. The water-soluble quenching composition of claim 1, further comprising:

(C) 0.5 to 50 parts by weight, relative to 100 parts by weight of the sum of (A)+(B), of an alkylene glycol having a weight average molecular weight of at most 1,000.

3. The water-soluble quenching composition of claim 1, further comprising:

(D) 0.5 to 25 parts by weight, relative to 100 parts by weight of the sum of (A)+(B), of an alkali metal carboxylate.

4. The water-soluble quenching composition of claim 1, further comprising:

(C) 0.5 to 50 parts by weight, relative to 100 parts by weight of the sum of (A)+(B), of an alkylene glycol having a weight average molecular weight of at most 1,000; and (D) 0.5 to 25 parts by weight, relative to 100 parts by weight of the sum of (A)+(B), of an alkali metal carboxylate.

5. The water-soluble quenching composition of claim 1, further comprising:

(E) 0.5 to 50 parts by weight, relative to 100 parts by weight of the sum of (A)+(B), of an organic amine compound having a weight average molecular weight of at least 1,000.

6. The water-soluble quenching composition of claim 1, further comprising:

(C) 0.5 to 50 parts by weight, relative to 100 parts by weight of the sum of (A)+(B), of an alkylene glycol having a weight average molecular weight of at most 1,000;

(D) 0.5 to 25 parts by weight, relative to 100 parts by weight of the sum of (A)+(B), of an alkali metal carboxylate; and (E) 0.5 to 50 parts by weight, relative to 100 parts by weight of the sum of (A)+(B), of an organic amine compound having a weight average molecular weight of at most 1,000.

7. The water-soluble quenching composition of claim 1, further comprising:

(C) 0.5 to 50 parts by weight, relative to 100 parts by weight of the sum of (A)+(B), of an alkylene glycol having a weight average molecular weight of at most 1,000; and (E) 0.5 to 50 parts by weight, relative to 100 parts by weight of the sum of (A)+(B), of an organic amine compound having a weight average molecular weight of at most 1,000.

8. The water-soluble quenching composition of claim 1, further comprising:

(D) 0.5 to 25 parts by weight, relative to 100 parts by weight of the sum of (A)+(B), of an alkali metal carboxylate; and (E) 0.5 to 50 parts by weight, relative to 100 parts by weight of the sum of (A)+(B), of an organic amine compound having a weight average molecular weight of at most 1,000.

9. The water-soluble quenching composition of claim 1, further comprising water.

10. The water-soluble quenching composition of claim 9, wherein the water content is from 10 to 98% by weight.

11. The water-soluble quenching composition of claim 1, wherein the weight average molecular weight of (A) is 20,000 to 100,000.

12. The water-soluble quenching composition of claim 1, wherein b is 0 and R is a hydrogen atom.

13. The water-soluble quenching composition of claim 1, wherein R is a residue derived from an aliphatic or aromatic hydroxyl compound selected from the group consisting of methyl alcohol, ethyl alcohol, n-propyl alcohol, isopropyl alcohol, n-butyl alcohol, isobutyl alcohol, sec-butyl alcohol, tert-butyl alcohol, hexyl alcohol, cyclohexyl alcohol, 2-ethylhexanol, ethylene glycol, propylene glycol, trimethylene glycol, butane-diol, neopentyl glycol, hexanediol, octane-diol, cyclohexane-diol, cyclohexane-dimethanol, glycerol, trimethylolethane, trimethylolpropane, pentaerytliritol, sorbitol, mannitol, dipentaerythritol, phenol, cresol, xylenol, ethylphenol, pyrocatechol, resorcinol, hydroquinone, dihydroxytoluene, phloroglucinol, benzyl alcohol and phenethyl alcohol.

14. The water-soluble quenching composition of claim 1, wherein the glycol ether (B) is represented by formula (II):

$$R^2—(OA^2)_m—OR^3 \quad \text{(II)}$$

wherein $R^2$ and $R^3$, independently, are a hydrogen atom or a hydrocarbon group having from 1 to 15 carbon atoms, provided that both $R^2$ and $R^3$ are not, simultaneously, each a hydrogen atom, each $A^2$ is, independently, an alkylene group having 2 to 6 carbon atoms, and m is a positive integer greater than or equal to 1.

15. The water-soluble quenchiing composition of claim 1, wherein the weight ratio of (A) to (B) is 3/1 to 100/1.

16. The water-soluble quenching composition of claim 1, wherein the weight ratio of (A) to (B) is 4/1 to 20/1.

17. The water-soluble quenching composition of claim 2, wherein the alkylene glycol (C) is represented by formula (III):

$$H—(OA^3)_k—OH \quad \text{(III)}$$

wherein $A^3$ is an alkylene group having 2 to 6 carbon atoms, and k is a positive integer greater than or equal to 1.

18. The water-soluble quenching composition of claim 3, wherein the alkali metal carboxylate is the alkali metal salt of an aliphatic or aromatic carboxylic acid.

19. The water-soluble quenching composition of claim 18, wherein the aliphatic carboxylic acid is a dicarboxylic acid having 3 to 36 carbon atoms and the aromatic carboxylic acid has 7 to 36 carbon atoms.

20. The water-soluble quenching composition of claim 5, wherein the organic amine is a cycloalkyl amine, an alkanolamine, a piperazine derivative, or a morpholine derivative.

21. A method of quenching metals, comprising applying the water-soluble quenching composition of claim 1 to a hot metal, thereby quenching the metal.

* * * * *